US007021968B1

(12) United States Patent
Lu

(10) Patent No.: US 7,021,968 B1
(45) Date of Patent: Apr. 4, 2006

(54) END SOCKET APPLICABLE TO CHRISTMAS DECORATION LOW-VOLTAGE BULBS

(75) Inventor: Chong Ying Lu, Miao-Li-Hsien (TW)

(73) Assignee: Wang Loong Co., Ltd., Miao-Li Hsien (TW)

( * ) Notice: Subject to any disclaimer, the term of this patent is extended or adjusted under 35 U.S.C. 154(b) by 0 days.

(21) Appl. No.: 11/181,938

(22) Filed: Jul. 15, 2005

(51) Int. Cl.
*H01R 13/66* (2006.01)

(52) U.S. Cl. ..... 439/620

(58) Field of Classification Search ..... 439/620, 439/621–622, 696, 106
See application file for complete search history.

(56) References Cited

U.S. PATENT DOCUMENTS 3,968,355 A * 7/1976 Smallegan ..... 362/642
4,717,350 A * 1/1988 Lax ..... 439/92
5,984,729 A * 11/1999 Hollander et al. ..... 439/620
6,132,257 A * 10/2000 Wang et al. ..... 439/622
6,190,207 B1 * 2/2001 Wang ..... 439/622

* cited by examiner

*Primary Examiner*—J. F. Duverne
(74) *Attorney, Agent, or Firm*—Rosenberg, Klein & Lee

(57) ABSTRACT

An end socket applicable to Christmas decoration low-voltage bulbs comprises a shell body, a first and a second conductive sheet, a diode, and an electric cable. The shell body has an receiving room with the first and second conductive sheets therein. The first and second conductive sheets are connected to a first conducting pin and a second conducting pin of a plug, respectively. One end of the diode is connected to the first conductive sheet. The electric cable is composed of a power line, a ground line, and a low-voltage power line. The power line is connected to the first conductive sheet. The ground line is connected to the second conductive sheet. The low-voltage power line is connected to the other end of the diode. Because the low-voltage power line provides a lower voltage to light up Christmas decoration low-voltage bulbs, the effect of energy saving can be accomplished.

10 Claims, 6 Drawing Sheets

END SOCKET APPLICABLE TO CHRISTMAS DECORATION LOW-VOLTAGE BULBS

BACKGROUND OF THE INVENTION

1. Field of the Invention

The present invention relates to an end socket applicable to Christmas decoration low-voltage bulbs and, more particularly, to an end socket having a low-voltage power line.

2. Description of Related Art

With continual progress of the science and technology, electric appliances have become indispensable to everyday work and life of people. When an electric appliance is used, a plug is used as a bridge for transfer of electric power. In general, plugs have different structures depending on their types. In addition to common plugs, there are also end sockets that can be used as bridges of electric power. An end socket can be inserted by another plug to facilitate convenient use.

Christmas decoration light strings commonly used for enhancing Christmas mood in various situations are generally arranged in a large range. The higher the AC voltage, the larger the electric power consumption. Therefore, the electric power dissipated by Christmas bulbs on a Christmas light string is considerable. In addition to having a high cost, the requirement of environmental protection is not met.

The present invention provides an end socket applicable to Christmas decoration low-voltage bulbs to accomplish the effects of illumination and decoration of Christmas decoration low-voltage bulbs so as to save electric energy and meet the requirement of environmental protection.

SUMMARY OF THE INVENTION

An object of the present invention is to provide an end socket applicable to Christmas decoration low-voltage bulbs, in which a low-voltage power line provides a lower AC voltage to light up Christmas decoration low-voltage bulbs to achieve the effect of energy saving.

Another object of the present invention is to provide an end socket applicable to Christmas decoration low-voltage bulbs to lower the power consumption of Christmas light strings.

To achieve the above objects, an end socket applicable to Christmas decoration low-voltage bulbs of the present invention comprises a shell body, a first and a second conductive sheet, a diode, and an electric cable. The shell body has an receiving room with the first and second conductive sheets therein. The first and second conductive sheets are connected to a first conducting pin and a second conducting pin of a plug, respectively. One end of the diode is connected to the first conductive sheet. The electric cable is composed of a power line, a ground line, and a low-voltage power line. The power line is connected to the first conductive sheet. The ground line is connected to the second conductive sheet. The low-voltage power line is connected to the other end of the diode. The plug comprises a shell body, an electric cable, and a first and second conducting pin. The shell body has an receiving room therein. The electric cable is composed of a power line, a ground line, and a low-voltage power line. The first and second conducting pins are disposed in the receiving room. The power line is connected to the first conducting pin. The ground line is connected to the second conducting pin. The low-voltage power line is grounded. A plurality of Christmas decoration low-voltage bulbs is disposed on the low-voltage power line and the ground line.

BRIEF DESCRIPTION OF THE DRAWINGS

The various objects and advantages of the present invention will be more readily understood from the following detailed description when read in conjunction with the appended drawing, in which.

DETAILED DESCRIPTION OF THE PREFERRED EMBODIMENTS

Figure 1:
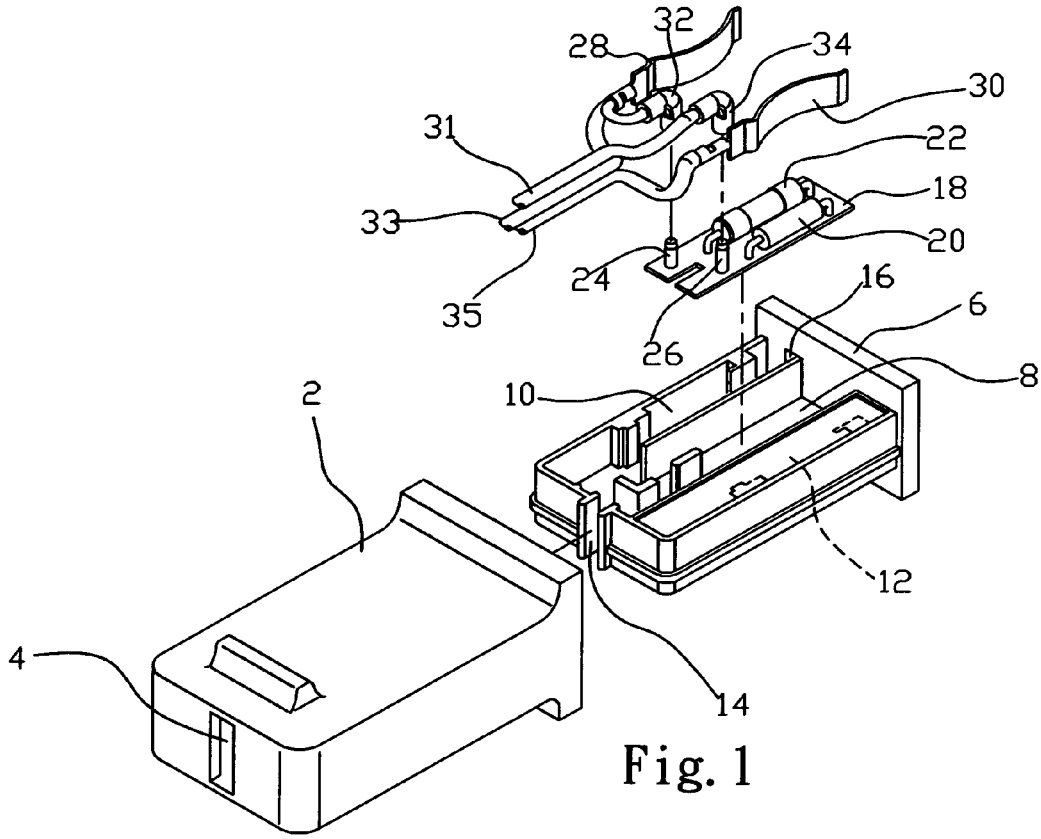
FIG. 1 is an exploded perspective view of the structure of an end socket of the present invention.
Figure 2:
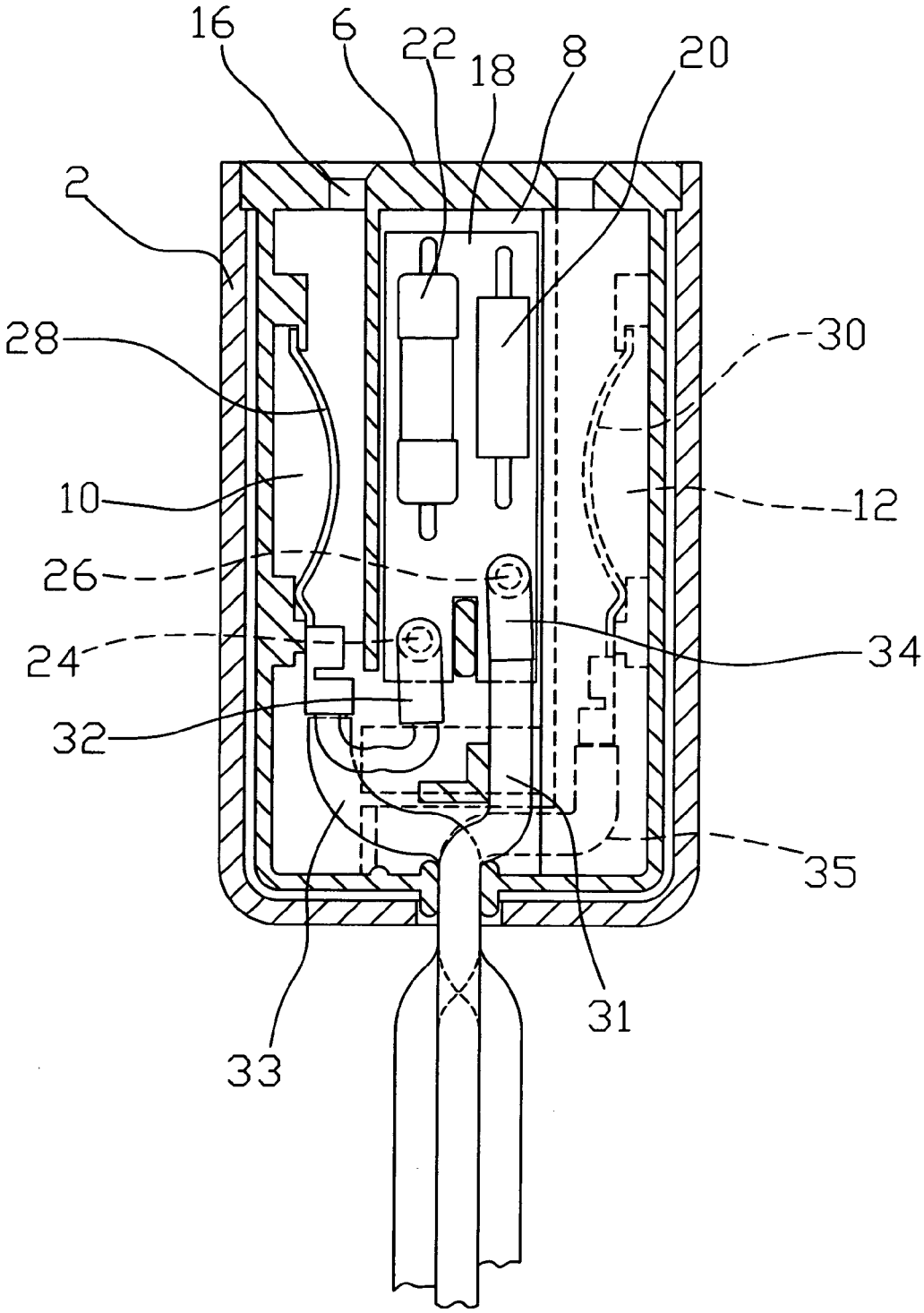
FIG. 2 is a perspective view of the structure of an end socket of the present invention.
Figure 3:
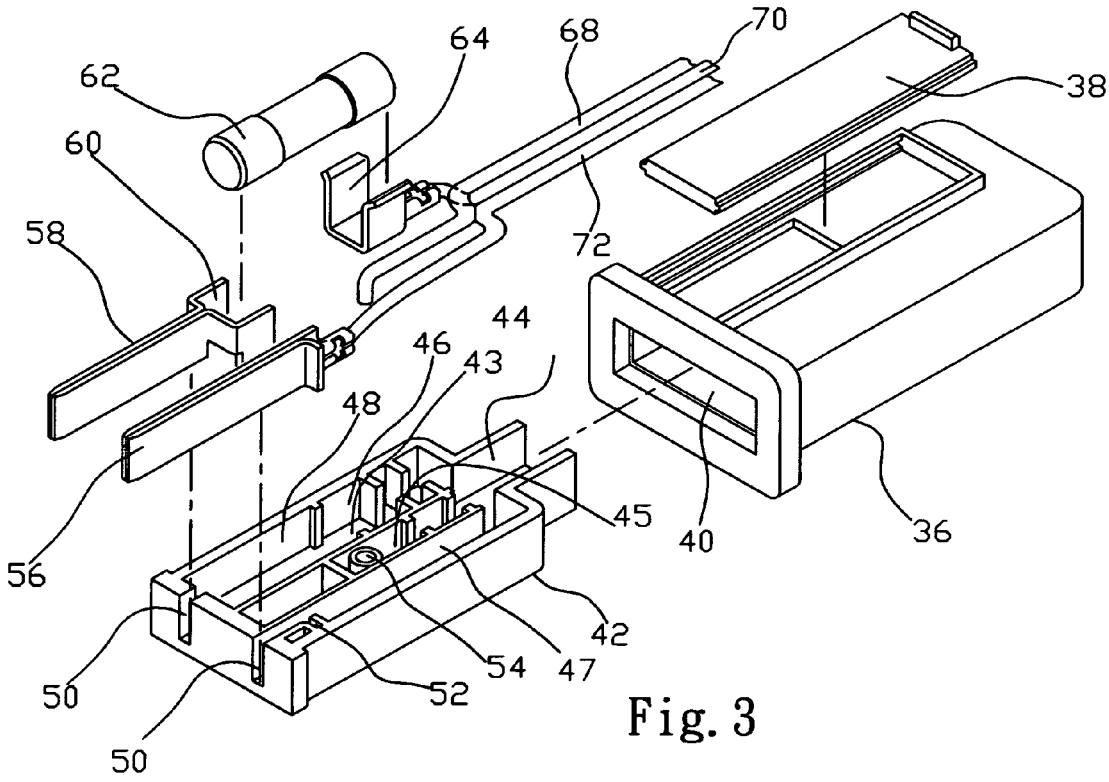
FIG. 3 is an exploded perspective view of the structure of a plug of the present invention.

The present invention provides an end socket applicable to Christmas decoration low-voltage bulbs. As shown in FIGS. 1 and 2, the main body of an end socket is composed of a housing 2 and an receiving room 6. The housing 2 has a hole 4 so that an electric cable can pass through and be connected into the end socket. The receiving room 6 has an opening 14. The receiving room 6 has three tanks: a first tank 10, a second tank 8, and a third tank 12. The hole 4 is connected with the receiving room 6 so that an electric cable can pass through the hole 4 into the receiving room 6. The electric cable is composed of a power line 33, a ground line 35, and a low-voltage power line 31. A baffle 16 is disposed between the first tank 10 and a second tank 8 for isolation. The baffle 16 does not completely separate the first tank 10 and the second tank 8. The first tank 10 is still connected with the second tank 8. The third tank 12 is completely separated from the first tank 10 and the second tank 8. The first tank 10 has a first conductive sheet 28 therein. A second conductive sheet 30 is disposed in the third tank 12. The first conductive sheet 28 is electrically connected to the power line 33. The second conductive sheet 30 is electrically connected to the ground line 35. The first tank 10 and the third tank 12 have holes so that the first conductive sheet 28 and the second conductive sheet 30 can be connected to external conducting pins, respectively. A circuit board 18 is provided in the receiving room 6. The circuit board 18 has a diode 20, a fuse 22, a low-voltage conducting connector 26, and a power source conducting connector 24. The fuse 24 is used to protect the diode 20. One end of the low-voltage power line 31 is electrically connected to an electroplated copper 34. The electroplated copper 34 is connected with the low-voltage conducting connector 26. The power source conducting connector 24 is connected with a conducting line 32. The other end of the conducting line 32 is connected to the first conductive sheet 28. The AC voltage of the power line 33 is stepped down by the diode 20 on the circuit board 18 via the conducting line 32 to let the low-voltage power line 31 have an AC voltage lower than that of the power line 33. Generally, the AC voltages of the power line 33 and the ground line 35 are 110 V and 0 V, respectively, and the low-voltage power line 31 has an AC voltage of 50–60 V. The end socket with all its components assembled is shown in FIG. 2.

Figure 4:
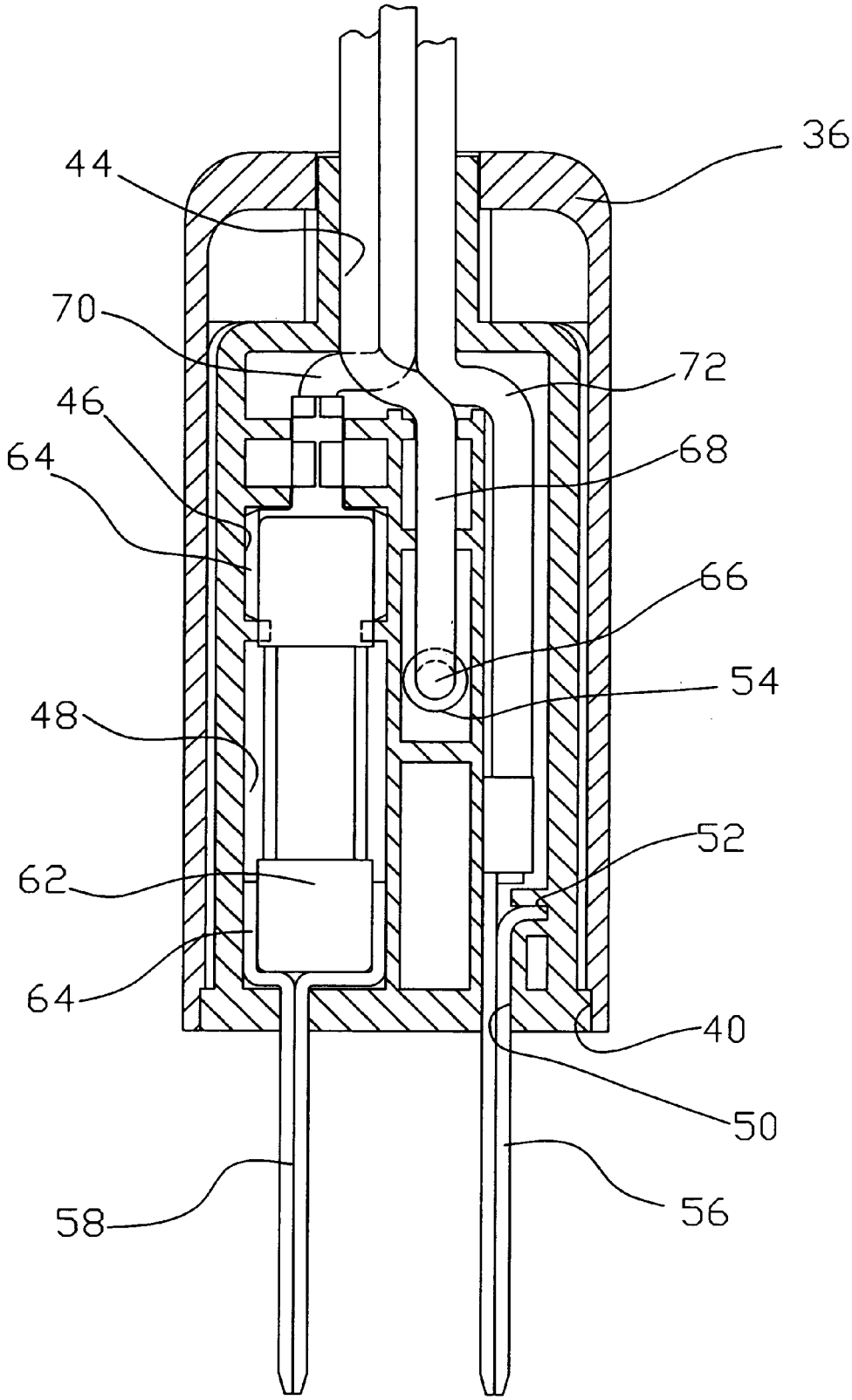
FIG. 4 is a perspective view of the structure of a plug of the present invention.

As shown in FIG. 4, the main body of a plug is composed of a housing 36 and an receiving room 42. The housing 36 has a through hole 40 so that an electric cable can pass through and be connected into the plug. A movable sheet 38 is located on the housing 36. The movable sheet 38 can push the receiving room 42 to separate the receiving room 42 and the housing 36. The receiving room 42 has three tanks: a first tank 43, a second tank 45, and a third tank 47. all the three tanks are connected with a hole 44. Except the region connected with the hole 44, the three tanks 43, 45 and 47 are separated with insulating material. That is, all the there tanks 43, 45 and 47 have insulating baffles. An electric cable passes through the hole 44 into the receiving room 42. The first and third tanks 43 and 47 have holes 50, respectively. The electric cable is composed of a power line 70, a ground line 72, and a low-voltage power line 68. The first tank 43 has a first conducting pin 58 therein. The first conducting pin 58 protrudes out of the hole 50 to be connected to a first conductive sheet 60. A fuse 62 is disposed in a fixing groove 48 in the first tank 43. The first conductive sheet 60 is located at one end of the fuse 62. The other end of the fuse 62 has a second conductive sheet 64. The second conductive sheet 64 is fixed in a fixing groove 46 in the first tank 43. The second conductive sheet 64 is connected to the power line 70 to achieve electric connection between the first conducting pin 58 and the power line 70. The second conducting pin 56 is fastened in a fastening groove 52 in the third tank 57. The second conducting pin 56 protrudes out of the hole 50 to be electrically connected to the ground line 70. An insulating pole 54 in disposed in the receiving room 42 as a grounding area. The low-voltage power line 68 is connected to the insulating pole 54. Generally, the AC voltages of the power line 70 and the ground line 72 are 110 V and 0 V, respectively, and the low-voltage power line 68 has an AC voltage of 50–60 V The plug with all its components assembled is shown in FIG. 4. The housing and receiving room of the plug or the end socket are made of insulating material by means of integral formation such as injection molding.

Figure 5:
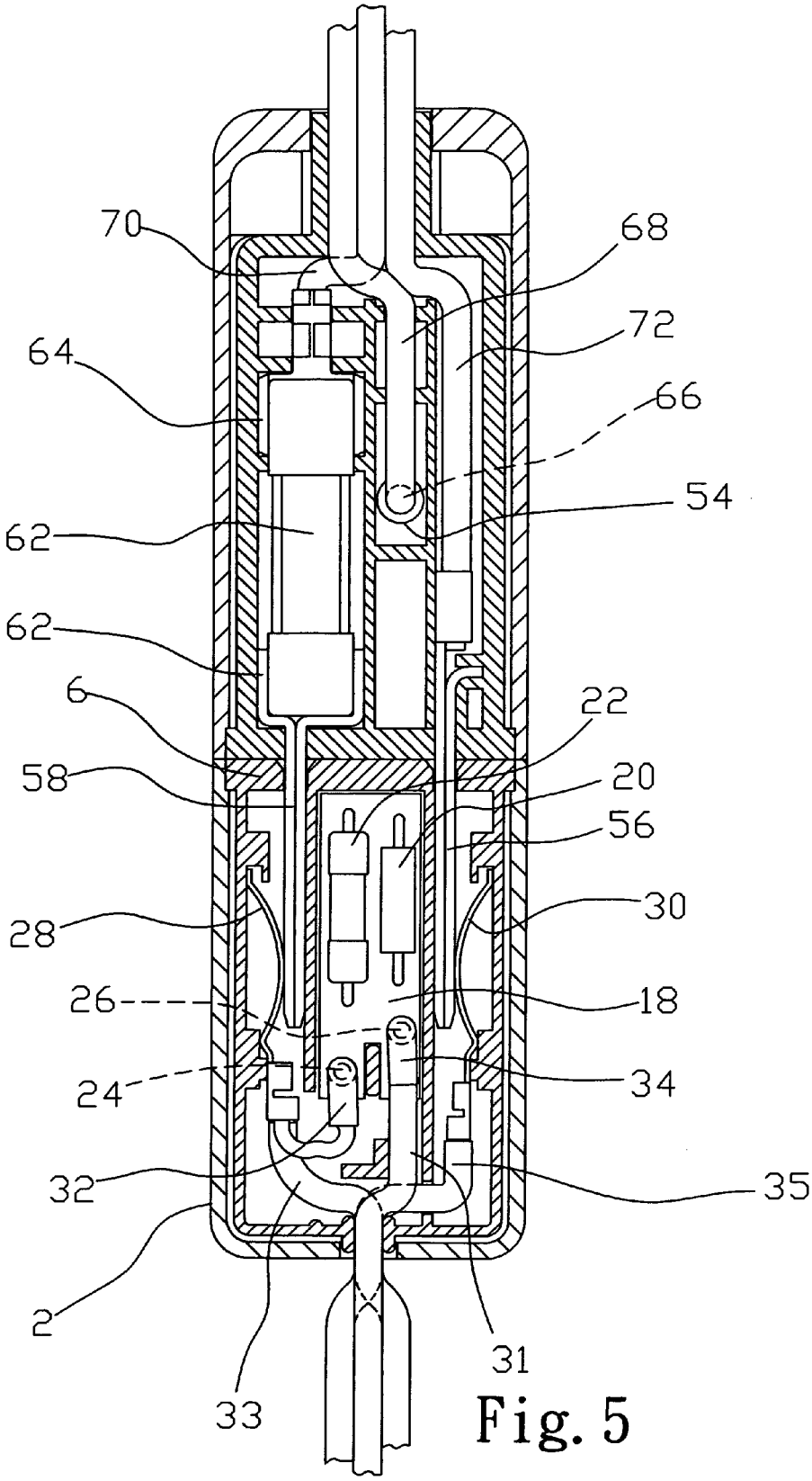
FIG. 5 is a diagram showing the combination of an end socket and a plug of the present invention.

As shown in FIG. 5, assuming the current flows from the plug to the end socket. After the current of the power line 68 of the plug passes the first conducting pin 58 and flows to the first conductive sheet 28, it is divided into two components, one continues providing an AC voltage of 110 V for the power line 33, the other flows to the power source conducting connector 24 via the conducting line 32 and reaches the circuit board 18. After the current reaching the circuit board 18 is stepped down by the diode 20 and protected by the fuse 22, it reaches the low-voltage power connector 26 and then flows to the low-voltage power line 31. The ground line 72 of the plug is connected to the ground line 35 of the end socket through electric connection of the second conducting pin 56 and the second conductive sheet 30 so that the AC voltage of the ground line of the end socket can still be kept at 0 V.

Figure 6:
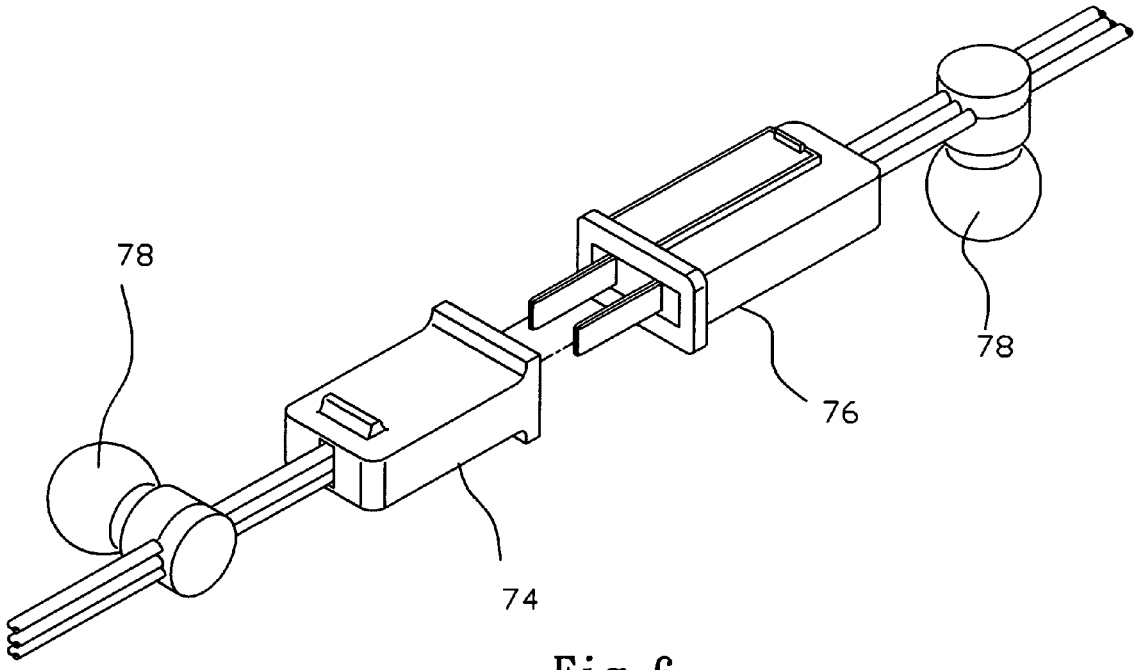
FIG. 6 is a diagram showing how the present invention applies to Christmas decoration low-voltage bulbs.

As shown in FIG. 6, Christmas decoration low-voltage bulbs 78 are electrified by the low-voltage power lines instead of the power lines in the prior art. After the end socket 74 and the plug 76 are connected together, the low-voltage power line of the end socket 74 with an AC voltage of 50–60 V provides electric power for the Christmas decoration low-voltage bulbs to light up them so as to save electric energy and lower the expenditure on electricity.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. An end socket applicable to Christmas decoration low-voltage bulbs, comprising:

a shell body having an receiving room;

a first and a second conductive sheet disposed in said receiving room and connected to a plug;

a diode, one end of said diode being connected to said first conductive sheet; and an electric cable composed of a power line, a ground line, and a low-voltage power line, said power line being connected to said first conductive sheet, said ground line being connected to said second conductive sheet, said low-voltage power line being connected to the other end of said diode, a plurality of Christmas decoration low-voltage bulbs being disposed on said low-voltage power line and said ground line.

2. The end socket applicable to Christmas decoration low-voltage bulbs as claimed in claim 1, wherein said power line has an AC voltage of 110 V, said ground line has an AC voltage of 110 V, and said low-voltage power line has an AC voltage of 50–60 V.

3. The end socket applicable to Christmas decoration low-voltage bulbs as claimed in claim 1, wherein said plug comprises a shell body, an electric cable, and a first and second conducting pin, said shell body has an receiving room therein, said electric cable is composed of a power line, a ground line, and a low-voltage power line, said first and second conducting pins are disposed in said receiving room, said power line is connected to said first conducting pin, said ground line is connected to said second conducting pin, said low-voltage power line is grounded, and a plurality of Christmas decoration low-voltage bulbs is disposed on said low-voltage power line and said ground line.

4. The end socket applicable to Christmas decoration low-voltage bulbs as claimed in claim 1 further comprising a fuse connected to said diode to enhance safety of said end socket.

5. The end socket applicable to Christmas decoration low-voltage bulbs as claimed in claim 4, wherein said fuse and said diode are disposed on a circuit board.

6. The end socket applicable to Christmas decoration low-voltage bulbs as claimed in claim 3, wherein a fuse is further provided between said first conducting pin and said power line to enhance safety of said plug.

7. The end socket applicable to Christmas decoration low-voltage bulbs as claimed in claim 1, wherein said shell body is made of insulating material.

8. The end socket applicable to Christmas decoration low-voltage bulbs as claimed in claim 1, wherein said shell body is integrally formed.

9. The end socket applicable to Christmas decoration low-voltage bulbs as claimed in claim 3, wherein said shell body is integrally formed.

10. The end socket applicable to Christmas decoration low-voltage bulbs as claimed in claim 3, wherein said shell body is made of insulating material.

* * * * *